United States Patent [19]

Hu

[11] Patent Number: 4,609,410

[45] Date of Patent: Sep. 2, 1986

[54] METHOD FOR PRODUCING HIGH-STRENGTH DEEP-DRAWABLE DUAL-PHASE STEEL SHEETS

[75] Inventor: Hsun Hu, Murrysville, Pa.

[73] Assignee: United States Steel Corporation, Pittsburgh, Pa.

[21] Appl. No.: 585,611

[22] Filed: Mar. 5, 1984

Related U.S. Application Data

[63] Continuation of Ser. No. 212,786, Dec. 4, 1980, abandoned.

[51] Int. Cl.[4] ..... C21D 9/52

[52] U.S. Cl. ..... 148/142; 148/12 F; 148/12.4

[58] Field of Search ..... 148/12 C, 12.4, 12 F, 148/142

[56] References Cited

U.S. PATENT DOCUMENTS 3,954,516 5/1976 Hu ..... 148/12 C
4,050,959 9/1977 Nakaoka et al. ..... 148/12.4
4,062,700 12/1977 Hayami et al. ..... 148/134
4,145,235 3/1979 Gondo et al. ..... 148/142
4,292,097 9/1981 Nakazato et al. ..... 148/12 C

FOREIGN PATENT DOCUMENTS 115620 9/1979 Japan ..... 148/12 C
135615 10/1979 Japan ..... 148/12 C

*Primary Examiner*—Wayland Stallard
*Attorney, Agent, or Firm*—Arthur J. Grief

[57] ABSTRACT

High-strength, deep-drawable, steel sheet exhibiting dual-phase properties is produced by (i) initially annealing the sheet to achieve crystallographic textures yielding high deep drawability, (ii) heating the sheet to a temperature above the $A_1$ for a time sufficient to produce from 2 to 10% austenite, and thereafter (iii) rapidly cooling to transform at least a portion of the austenite to martensite or bainite. To achieve such transformation of austenite, the composition of the steel must be selected to provide a requisite degree of hardenability.

7 Claims, No Drawings

METHOD FOR PRODUCING HIGH-STRENGTH DEEP-DRAWABLE DUAL-PHASE STEEL SHEETS

This application is a continuation of Ser. No. 212,786, filed Dec. 4, 1980, now abandoned.

This invention is directed to a method for the production of dual-phase steel sheet or strip products with improved deep drawability.

The past decade has seen the development of dual-phase steels, characterized by a microstructure which is basically a matrix of ferrite containing from about 10 to 30% martensite or lower bainite. The resulting microstructure provides a steel with an initially low yield strength, typically in the range of 50 to 60 ksi, thereby affording ease of formability; but which as a result of the strains developed by forming, more closely approaches the ultimate tensile strength of the steel, typically in the range of 80 to 90 ksi. A variety of thermomechanical processing methods have been proposed for the production of such dual-phase steels. In general, these methods involve heating the steel to a temperature in the two-phase, alpha + gamma region (e.g. U.S. Pat. Nos. 3,502,514 or 3,914,135); or to above the $A_3$ region for a brief period, avoiding undesirable grain growth (e.g. U.S. Pat. Nos. 3,914,135 or 4,033,789), to produce a minimum amount of austenite which when rapidly cooled will decompose to martensite or bainite. The formability of dual-phase steels, coupled with their relatively high-strength to weight ratios, have led to the adoption of such steels for the production of automotive parts such as bumpers, wheel racks, brackets—primarily as hot-rolled products. To date, however, cold-rolled, dual-phase steels have not been employed for the production of automobile body panels, one reason being that steel sheets for body panel applications must have good deep-drawing capabilities. It is recognized that the performance of a steel sheet or strip during deep-drawing operations, is closely associated with $r_m$ value, which is the ratio of true width strain to true thickness strain when the sheet is strained in tension. Apparently, the $r_m$ values of dual-phase steel sheets are invariably poor, i.e. around unity (see, for example, Hayami et al., *Formable HSLA and Dual-Phase Steels,* Conference Proceedings, TMS-AIME, 1979, pages 167 to 180). Thus, in comparison with the solution strengthened, deep-drawing steels having $r_m$ values of the order of 1.6 to 2.0 and yield strengths of the order of 40 ksi, the presently available, dual-phase steels are much inferior. For deep drawing applications, crystallographic texture must be strongly (111) with very little (100) and other undesirable orientations. Although strong (111) textures can be produced successfully in various low-carbon sheet steels, development of an equally strong (111) texture in the ferrite + martensite aggregate would be much more difficult to accomplish. This is because it is difficult to achieve a sharp texture in martensite due to the nature of the transformation variance. It has now been found that if proper orientations [e.g. the predominant (111) texture] are first developed or provided to the steel, and if the steel is thereafter briefly intercritically annealed so that local regions with a high carbon content could become austenite pools at the intercritical temperature, these austenized regions will, upon rapid cooling, transform to martensite or bainite without unduly affecting the ferrite matrix—if the amount of martensite formed is small.

The production of a requisite minimum amount of martensite necessitates that the steel contain at least about 0.02% carbon in uncombined form; whereas if the carbon is present in uncombined form, in amounts significantly in excess of 0.15%, the desired deep drawability will not be achieved. Similarly, good deep drawability will not be obtained if manganese is in excess of 0.4% (preferably less than 0.3%), or if oxygen is in excess of 500 ppm (preferably less than 300 ppm). Steel compositions within the above parameters known to provide good deep drawability, are phosphorus containing or silicon-phosphorous containing steels described in U.S. Pat. No. 3,954,516, as well as certain of the compositions described in U.S. Pat. No. 3,827,924, the disclosures of which patents are hereby incorporated by reference. Examples of three such steels were treated in the laboratory to provide an illustration of the properties which could be achieved. The chemical composition of these illustrative steels is provided in Table I below.

TABLE I

| | Chemical Composition of Air-Melted Silicon-Phosphorus Steels, Wt % | | | | | | | | | | | |
|---|---|---|---|---|---|---|---|---|---|---|---|---|
| Steel | C | Mn | P | S | Si | Cu | Ni | Cr | $Al_{Sol}$ | $Al_{total}$ | N | $O_{ppm}$ |
| A | 0.038 | 0.135 | 0.066 | 0.018 | 0.408 | 0.007 | 0.005 | 0.018 | 0.001 | 0.002 | 0.006 | 251 |
| B | 0.040 | 0.134 | 0.068 | 0.017 | 0.724 | 0.010 | 0.002 | 0.018 | 0.001 | 0.004 | 0.006 | 223 |
| C | 0.044 | 0.154 | 0.070 | 0.017 | 1.071 | 0.010 | 0.002 | 0.020 | 0.001 | 0.004 | 0.006 | 178 |

Initially, samples were given a simulated box-annealing treatment at 780° C. for a period of four hours. Although the use of such a shortened soak period will result in some sacrifice of deep-drawing texture, it was deemed to be preferential, in order to reduce grain size and thereby attain a more uniform distribution of martensite during the subsequent transformation. After this four-hour hold at temperature, the specimens were cooled by removing them from the hot zone to the colder zone of the furnace. This simulated an accelerated cooling rate attainable in box-annealing and was intended further to reduce the size of the carbides or pearlite colonies at the grain boundaries. Thus, it was hoped that, upon subsequent intercritical annealing, small austenite pools would form at these regions and thereby be more uniformly distributed throughout the ferrite matrix. Subsequently, to simulate continuous annealing, selected sets of specimens were heat treated in a lead bath at 740° C., 760° C., and 780° C. for one minute and thereafter quenched. The resulting mechanical properties of these specimens are reported in Table II.

As may be noted from the tabulation under treatment (2) in Table II, the intercritical heat treatment at 740° C. followed by quenching in water resulted in substantial increases in the yield and tensile strengths and a corresponding decrease in ductility. The yield point elongation or Lüders strain in the quenched specimens was appreciably smaller, even though the grain size was slightly smaller and the amount of martensite produced was only about 1%. Although $r_m$ values decreased slightly, i.e. to about 1.7, it should nevertheless be noted that at such high strength levels (71 to 76 ksi yield strength and 95 to 100 ksi tensile strength) $r_m$ values at a level of about 1.7 are quite impressive.

For the specimens heat treated at higher intercritical temperatures, i.e. 760° and 780° C., mechanical properties of microstructural features are summarized under treatments (3), (4) and (5) in Table II. It can be noted that the yield point elongation was completely eliminated in specimens having higher silicon content, i.e. steels B and C. The amount of martensite in these specimens was substantially higher, being about 3 to 4%, than those specimens quenched from 740° C. For Steel A which contained 0.41% silicon, no change of the yield point elongation was observed when the heat treating temperature was increased to 760° or 780° C. and the amount of martensite showed only insignificant variations. The $r_m$ values, in particular, for the steels having relatively high silicon contents, were in the range 1.7 to 1.85. The yield and tensile strengths of these specimens were in the range 55 to 65 ksi and 75 to 100 ksi, respectively. The change in initial strain hardening rate, resulting from the intercritical heat treatment can be noted by the increase in flow stress after 4% elongation (column labeled "$\sigma$0.04"). With the presence of yield point elongation of about 1 to 2%, the increase in flow strength at 4% elongation ranged from 10 to 14 ksi. When the yield point elongation was completely eliminated, the corresponding increase in flow stress ranged from 17 to 20 ksi. Nevertheless, in comparison with properties characteristic of dual-phase steels having substantially enriched alloy compositions and greater volume fractions of martensite, the initial strain hardening rate and the total elongation were much lower in the present specimens. However, both ductility and initial strain-hardening rate could be improved by changing the steel composition to increase the hardenability, for example, by utilizing elements such as nickel, which would have little or no effect on the annealing texture or the $r_m$ value. Such increased hardenability would enable the employment of less severe cooling rates from the intercritical anneal, thereby minimizing supersaturation and quenched aging of the ferrite matrix.

TABLE II

Properties of Silicon-Phosphorus Steels, Heat-Treated at Various Intercritical Temperatures Then Quenched

| Steel | YS* ksi | $\sigma$0.04 ksi | TS ksi | Yp El % | Unif El in 1 in., % | Tot El in 1 in., % | $r_m$ | $\alpha'$ % | G.S. $\mu$m |
|---|---|---|---|---|---|---|---|---|---|
| Simulated box-annealed to 780° C. (1436° F.), held at temp for 4 hr, cooled in cool zone, then | | | | | | | | | |
| 1. No additional Heat Treatment | | | | | | | | | |
| A | 41.5 | 45.4 | 59.8 | 3.0 | 25.8 | 33.7 | 1.94 | 0 | 17 |
| B | 46.5 | 50.7 | 65.1 | 3.0 | 25.5 | 34.2 | 1.78 | 0 | 17 |
| C | 49.5 | 53.4 | 67.8 | 3.2 | 25.9 | 33.6 | 1.89 | 0 | 17 |
| 2. Heat-treated in Lead Bath at 740° C. (1364° F.) for 1 min, Water-quenched | | | | | | | | | |
| A | 71.4 | 84.6 | 94.7 | 1.1 | 13.3 | 15.6 | 1.66 | 1.0 | 16 |
| B | 76.0 | 89.2 | 100.4 | 1.0 | 13.0 | 16.5 | 1.73 | 1.0 | 16 |
| C | 73.4 | 84.5 | 96.0 | 1.7 | 14.3 | 16.4 | 1.77 | 1.0 | 16 |
| 3. Heat-treated in Lead Bath at 760° C. (1400° F.) for 1 min, Water-quenched | | | | | | | | | |
| A | 55.5 | 67.4 | 77.5 | 1.0 | 12.9 | 17.1 | 1.52 | 2.0 | 18 |
| B | 59.8 | 78.1 | 89.9 | 0 | 13.9 | 17.3 | 1.75 | 4.0 | 17 |
| C | 64.2 | 83.3 | 95.1 | 0 | 14.1 | 16.2 | 1.71 | 4.0 | 17 |
| 4. Heat-treated in Lead Bath at 760° C. (1400° F.) for 1 min, Oil-quenched | | | | | | | | | |
| A | 57.4 | 67.5 | 76.5 | 1.1 | 13.6 | 16.5 | 1.46 | 1.0 | 16 |
| B | 59.0 | 76.2 | 88.1 | 0 | 14.7 | 18.9 | 1.85 | 2.8 | 16 |
| C | 67.7 | 87.2 | 99.3 | 0 | 12.8 | 15.2 | 1.75 | 2.6 | 16 |
| 5. Heat-treated in Lead Bath at 780° C. (1436° F.) for 1 min, Oil-quenched | | | | | | | | | |
| A | 62.0 | 76.2 | 86.0 | 1.1 | 12.3 | 14.0 | 1.73 | 1.7 | 17 |
| B | 64.6 | 83.7 | 95.5 | 0 | 14.2 | 17.9 | 1.85 | 3.7 | 17 |
| C | 67.4 | 86.3 | 97.9 | 0 | 15.1 | 18.7 | 1.69 | 3.7 | 17 |

*Lower yield strength or 0.2% offset.
Conversion Factor:
1 ksi = 6.895 MPa

Although box annealing has most widely been employed for the development of good deep-drawing properties in low carbon sheet steels; annealing with relatively rapid heating rates, such as in continuous annealing, can produce equally satisfactory results if (i) the prior hot processing conditions (such as the finishing and coiling temperature which influence the carbide size and the distribution in the hot rolled band), and (ii) the amount of subsequent cold rolling reduction are appropriately adjusted. Thus, as shown by Matsudo et al., *Texture of Crystalline Solids,* Volume 3, 1978, pages 53 to 72, when the carbide size is comparatively large, the $r_m$ value increases with increasing heating rate. Thus, annealing to produce a high $r_m$ value and the subsequent intercritical heat treatment for the production of from about 2 to 10% austenite can be accomplished in one continuous anneal—eliminating the separate intercritical heat treatment utilized in the aforementioned examples. In either case, the steel sheet will be annealed to provide a crystallographic texture capable of yielding an $r_m$ value greater than 1.5 and preferably greater than 1.7. The next heating phase, whether performed as part of the initial anneal for texture formation or as a discrete step, will be conducted for a time and temperature (preferably within the range $A_1$ to $A_3$) sufficient to produce from about 2 to 10% austenite, preferably less than 7% austenite. Thereafter, the sheet will be cooled at a rate sufficient to transform all or a major portion of the austenite to martensite or bainite—the most preferred range of such decomposition products being about 3 to 5%.

I claim:

1. A method for the production of a steel sheet product which exhibits a yield strength/tensile strength ratio less than 0.75, a yield strength increase of at least 10 ksi after straining 4% and an $r_m$ value greater than 1.4, which comprises box annealing and cooling a steel sheet to produce an $r_m$ value greater than 1.5 in said sheet, heating said sheet to a temperature above the $A_1$ thereof for a time and temperature sufficient to produce from 2 to 10% austenite therein, cooling the sheet at a rate sufficient to transform at least a major portion of said austenite to decomposition products selected from the group of martensite, lower bainite, or combinations thereof, so as to produce such decomposition products in an amount of 2 to 10%, and in which said steel has a composition consisting essentially of 0.02 to 0.15% uncombined carbon, less than 0.4% manganese and less than 500 ppm oxygen, balance iron, the total of the alloy elements therein being sufficient to provide a degree of hardenability effective to transform said austenite to said amount of decomposition products.

2. The method of claim 1 wherein said sheet is heated to a temperature below the $A_3$ temperature thereof, for a time sufficient to produce less than 7% austenite.

3. The method of claim 2 in which said sheet is cooled at a rate sufficient to produce said decomposition products in an amount of 3 to 5%.

4. The method of claim 3 wherein said decomposition product is martensite.

5. The method of claim 1 wherein the sheet so provided has an $r_m$ value greater than 1.7, is heated to a temperature within the range $A_1$ to $A_3$ for a time sufficient to produce from 2 to 10% austenite and is thereafter cooled to transform said austenite to 3 to 7% martensite.

6. The method of claim 5, wherein said sheet product has a tensile strength of 75 to 100 ksi and an $r_m$ value greater than 1.7.

7. The method of claim 6, wherein said sheet product has a yield strength of 55 to 65 ksi and an $r_m$ value of 1.7 to 1.85.

* * * * *